US007798074B2

(12) United States Patent
Kashihara

(10) Patent No.: US 7,798,074 B2
(45) Date of Patent: Sep. 21, 2010

(54) LOADING RACK

(75) Inventor: Teruo Kashihara, Osaka (JP)

(73) Assignee: Nankai Kyogyo Co., Ltd. (JP)

( * ) Notice: Subject to any disclaimer, the term of this patent is extended or adjusted under 35 U.S.C. 154(b) by 791 days.

(21) Appl. No.: 11/784,856

(22) Filed: Apr. 10, 2007

(65) Prior Publication Data

US 2008/0060557 A1 Mar. 13, 2008

(30) Foreign Application Priority Data

Sep. 13, 2006 (JP) ..... 2006-247853

(51) Int. Cl.
*B65D 19/00* (2006.01)

(52) U.S. Cl. ..... 108/51.11; 220/1.5; 224/403; 410/129

(58) Field of Classification Search ..... 224/403, 224/404, 542; 220/1.5, 6; 108/51.11; 248/674; 410/129, 132, 142
See application file for complete search history.

(56) References Cited

U.S. PATENT DOCUMENTS 3,557,855 A * 1/1971 Weingarten et al. ..... 206/386
4,097,012 A * 6/1978 McIntyre ..... 248/674
4,162,737 A * 7/1979 Clive-Smith ..... 220/1.5
4,339,047 A * 7/1982 Johansson et al. ..... 220/1.5
7,152,749 B2 * 12/2006 Beck ..... 211/194

FOREIGN PATENT DOCUMENTS

JP 2005041299 A * 2/2005
JP 2005153815 A * 6/2005

* cited by examiner

*Primary Examiner*—Darnell M Jayne
*Assistant Examiner*—Patrick Hawn
(74) *Attorney, Agent, or Firm*—Wood, Phillips, Katz, Clark & Mortimer

(57) ABSTRACT

A loading rack with an oblong table body having a lateral extent and posterior and anterior ends and a pair of legs attached closably/foldably to posterior and anterior side parts of the body. The loading rack further has a plurality of leg holders which are attached at laterally spaced locations to the posterior and anterior side of the table body and a supporting hole which opens downwardly on each leg holder. Multiple insertion parts on an upper part of each of the legs can be inserted one each into the supporting holes. Each leg is held and fixed in a vertically standing position by peripheral walls surrounding the supporting holes as insertion parts are inserted into the supporting holes and the table body is loaded on the leg.

3 Claims, 7 Drawing Sheets

LOADING RACK

BACKGROUND OF THE INVENTION

1. Field of the Invention

This invention relates to the field of loading racks, which divide out the loading space of containers, box-shaped rear bodies of trucks, and the like vertically (upwardly and downwardly) so that the loading space is used efficiently.

2. Prior Art

As this kind of conventional loading racks, for example, racks written in following Patent Application Gazettes are known:

Japanese published unexamined application 2005-153815; and

Japanese published unexamined application 2005-041299.

Both of them have two legs, which have half the height of the box-shaped rear body of trucks and are fixed foldably to posterior and anterior side parts of an oblong table body, which vertically divides (partitions) the inner space of the rear box. Each of the legs has two poles, a horizontal frame of at the lower end, strengthening frames at vertical two places. A hinge of the leg is structured in a manner wherein a tabular key member whose end face is elliptical is fixed at an upper end of a longitudinal frame, a circular loosely engaging hole whose diameter is approximately the same as the length of the key member in a longitudinal direction and a rectangular engaging hole whose size is approximately the same as the end face of the key member are opened on a leg holder, the key member is engagingly inserted in the engaging hole so that the longitudinal frame is fixed to the holder in the standing position, and a table body is supported at a certain pallet height by the longitudinal frame. The table body is uplifted by a forklift so that the key member is moved to the loosely engaging hole and the longitudinal frame is revolved around the key member so that it is turned over.

SUMMARY OF THE INVENTION

An object of the present invention is to provide a strong repositionable leg for a loading rack, to ease the operation of the opening and closing of the leg, and to decrease the cost for manufacturing.

To achieve the aforementioned object, the present invention employs the following technical means.

The present invention is a loading rack wherein a legal is attached closably to posterior-and-anterior-side part of an oblong table body having a plurality of leg holders which are attached having a predetermine lateral distance to the posterior-and-anterior-side of the table body, a supporting hold which opens downwardly opened on each leg holder, and multiple insertion parts which are capable to be inserted into each hole attached to an upper part of each leg, wherein the leg is held and fixed in a vertically standing position by peripheral walls surrounding the supporting hole as the insertion part is inserted into the supporting hole and the table body is loaded on the leg. With the present invention, despite a simple structure, the leg is held in a standing position against a large moment by ensuring that enough length of the insertion parts extends into the supporting holes in the vertical direction. Also, almost all weight of the table body itself and the luggage loaded on the table body weighs on a part of the leg except the insertion part. Consequently, it is possible to enhance the stability of it when the truck is driven.

In the loading rack in said present invention, a long hole which extends vertically may be opened on a side wall of the peripheral walls, a latching pin which engages the long hole may be attached on an upper end part of the insertion part of the leg, and an opening which allows the leg to be closed inwardly when the leg is moved along the supporting hole till the latching pin is located to a lower end of the long hole may be opened at a lower end part of a inside wall of the peripheral walls. With this, the leg can be opened and closed as it is attached by the pin to the table body in a manner wherein the leg does not come free from the table body.

Also, the present invention may have a column-shaped guiding part located on an upper end of the insertion part, wherein a shape of cross section of the insertion part is almost the same as the shape of cross section of the supporting hole. With this, it is possible to decrease the frictional resistance during opening and closing the leg by the column-shaped guiding part so that it is possible to conduct opening and closing smoothly.

Moreover, each leg may have square pipe shaped poles which are lined up in a right-and-left row and a horizontal frame which connects poles next to each other at the vertically midway position of the poles, and each upper end of pole is the insertion part which is located at the upper part of each leg and the table body is loaded on the horizontal frame. By this, load of the table body is supported by a position lower than the insertion part, which constitutes a hinge, so that the load of the table body does not weigh on the hinge directly, and consequently, it is possible to achieve the more stable state.

Also, the present invention may further have a pin which projects upwardly at a middle of a left-right direction of each leg; and a fitting hole opened on the table body, in which the pin is inserted when the leg is in a standing position. With that, rattling of the leg in a standing position is decreased by reducing a fitting error between the pin and the fitting hole so that it is possible to achieve the more stable state.

The loading rack of said present invention may further have a claw bearing member attached to a lateral portion of the table body in which a fork of a forklift truck is inserted, wherein the claw bearing member is attached at a location so that the rack is able to be balanced when the fork is inserted in the claw bearing member. Even if the gravity point of the loading rack and the baggage on it is put to the front of the fork when the fork is inserted into the claw being member and the loading rack is lifted, it is possible to prevent them from falling down in front since the rack is supported by two points, which are on a front end of the fork which extends in front from the claw being part and the claw bearing part. Also, it is possible to load and unload the loading rack with baggage on it by the fork at the predetermined position and in a stable state wherein the front and back are not shaken since the claw bearing member is attached to a position in which the rack is able to be balanced when the fork is inserted into the claw bearing member. Consequently, it is possible to prevent baggage on the loading rack from losing balance and slipping down during loading and unloading.

It is preferable to make it possible to choose a state of the claw member from two states, of which one is a standing state wherein the claw bearing member is in a first angular relationship at a right angle to the table body and the other state is a closed state wherein the claw bearing member is in a different angular relationship parallel to the table body. With this construction, by folding the claw bearing member when the leg is in the standing position to put baggage both above and below the table body, it is possible to prevent the space for storing baggage under the table from being reduced caused by the claw bearing member which is in a standing state and the baggage from getting broken by contacting the claw bearing member.

In this case, it is preferable to have an engaging member, which fixes the state, as the claw bearing member is in a closed state wherein it is parallel to the table body. With this construction, it is possible to maintain the closing state without fail and prevent the claw bearing member from hanging downwardly by itself as caused by vibration during movement of the vehicle.

Moreover, it is preferable to have a holding assembly, which temporarily holds the standing state of the claw bearing member wherein the claw bearing member is at right angle to the table body. With this, it is possible to eliminate the shakiness, such as wobbling, of the claw bearing member when it is in the standing state, so that the fork is inserted to the claw bearing member easily.

With the present invention, despite a simple structure, it is possible to achieve an enhancement of the strength of hinged legs for the loading rack and facilitate opening and closing of the legs. The legs may be held in a standing state against a large moment by ensuring the enough length of the insertion parts extends into the supporting holes in the vertical direction.

THE PREFERRED EMBODIMENTS

Figure 1:
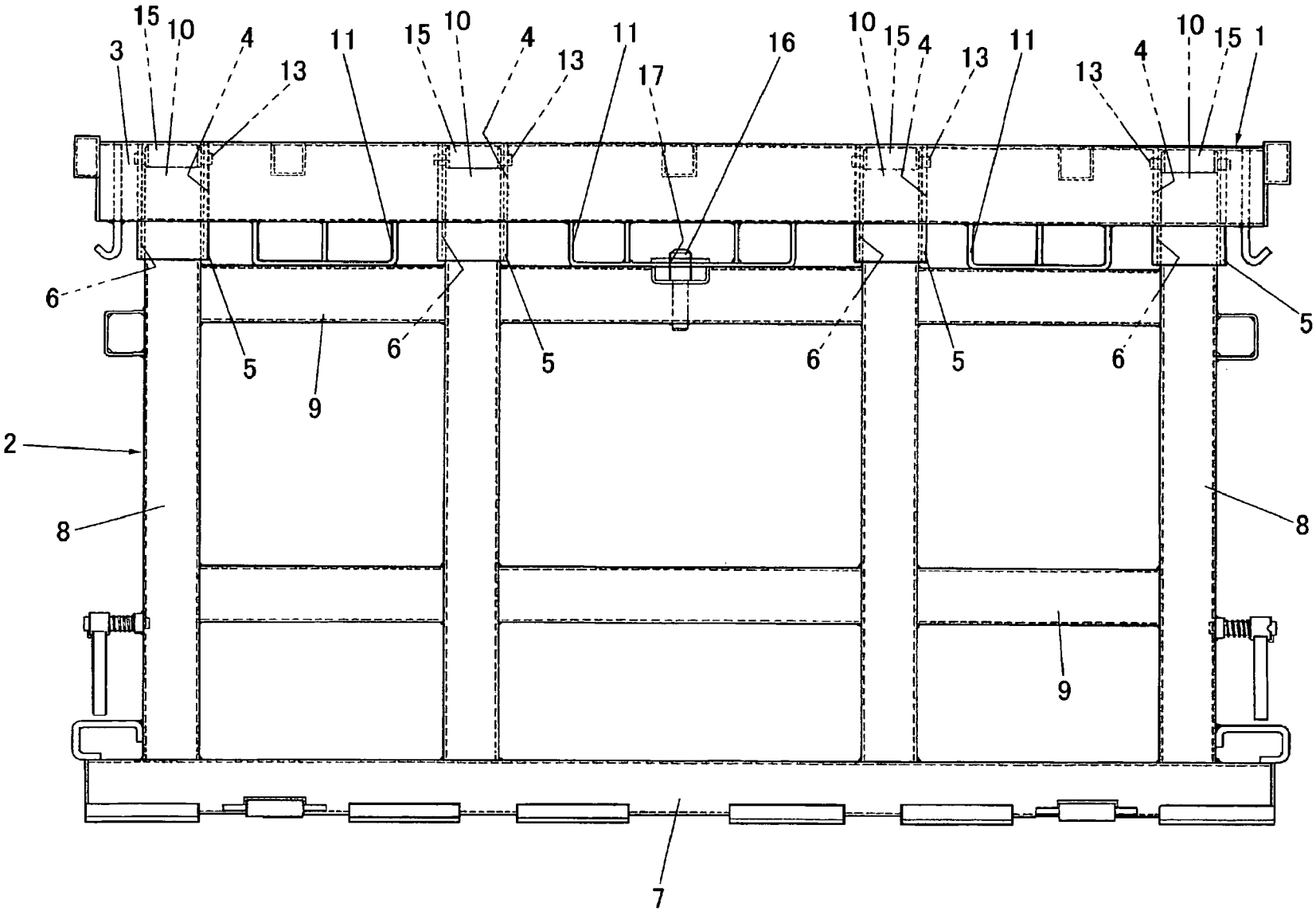
FIG. 1 Elevation view of a loading rack of one embodiment of the present invention.
Figure 2:
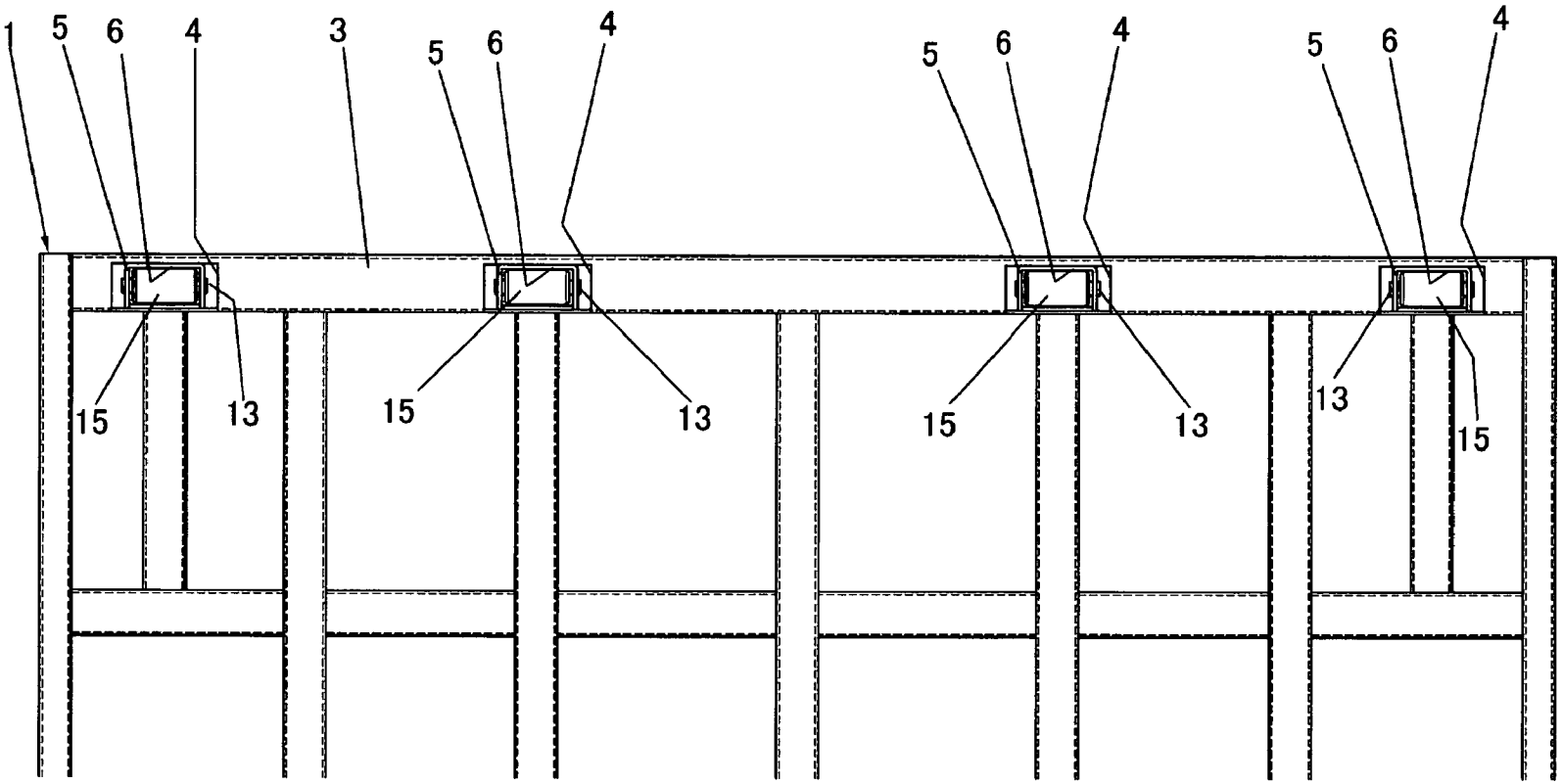
FIG. 2 Fragmentary plan view of the front/back of the loading rack from which perspectives the loading rack is the same in appearance.
Figure 3:
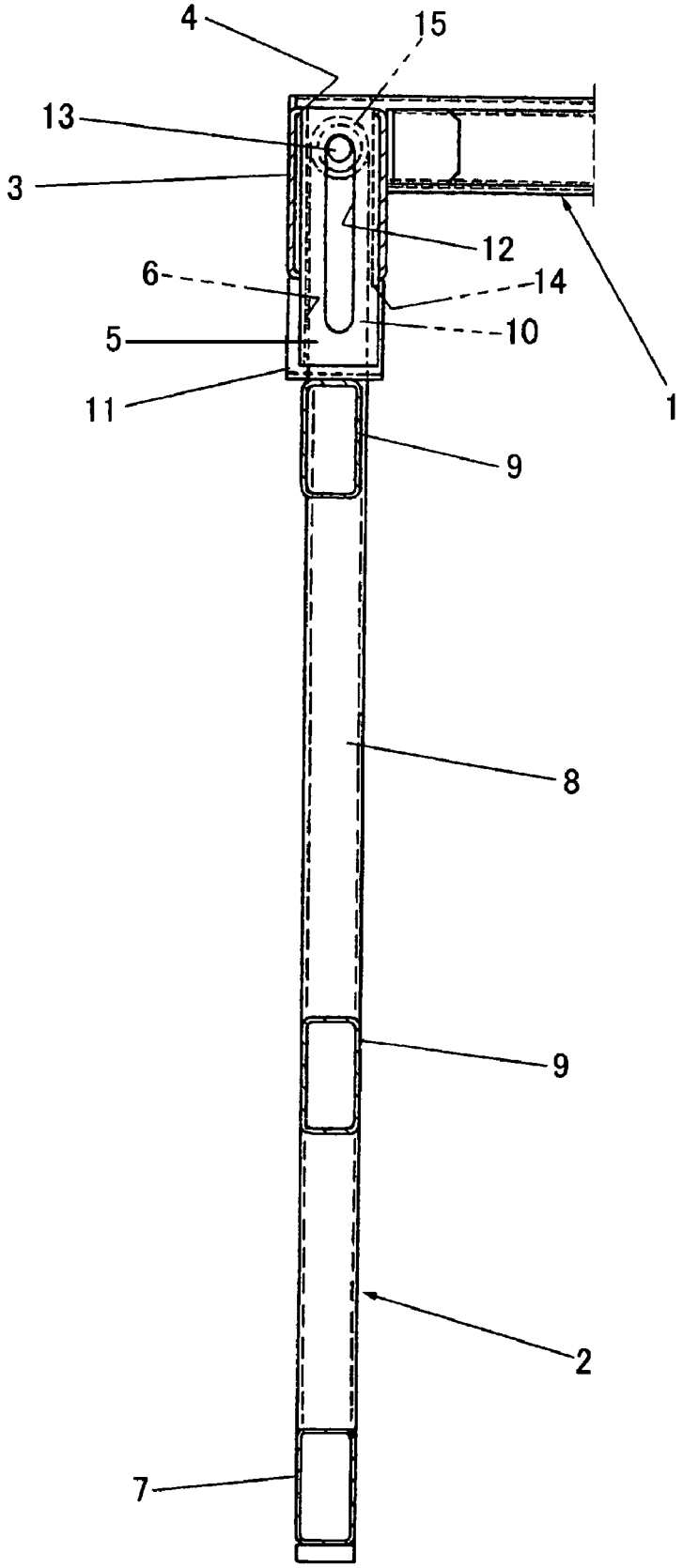
FIG. 3 Fragmentary, cross-sectional side view of of a leg on the loading rack.
Figure 4:
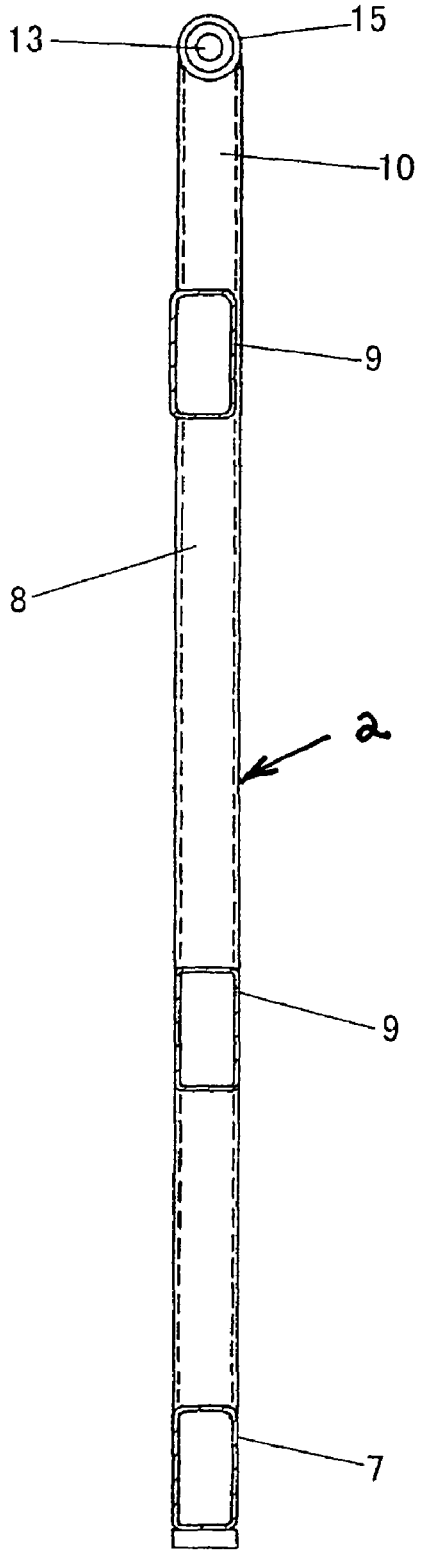
FIG. 4 Cross-sectional side view of the leg.
Figure 5:
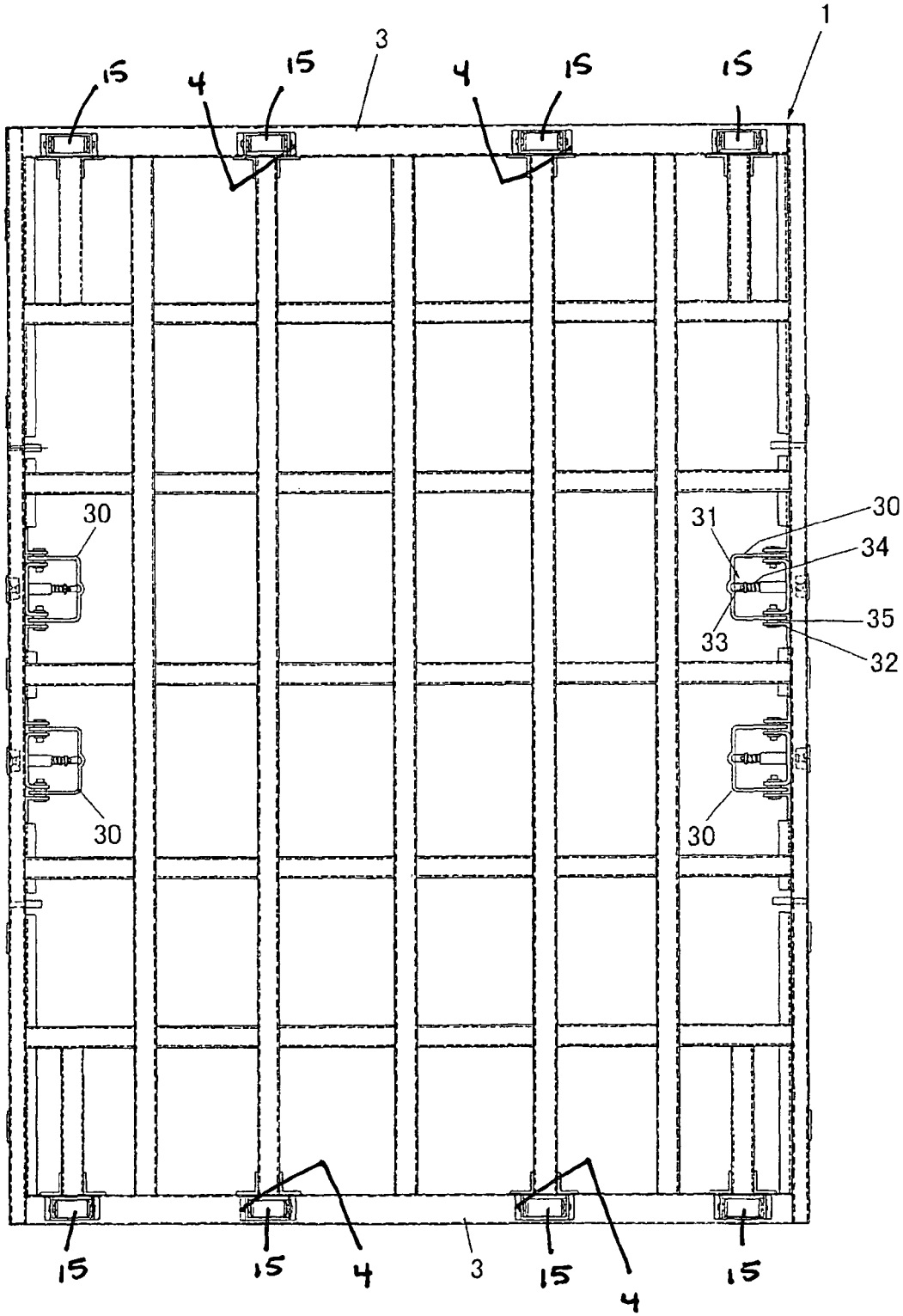
FIG. 5 Plan view of the loading rack.
Figure 6:
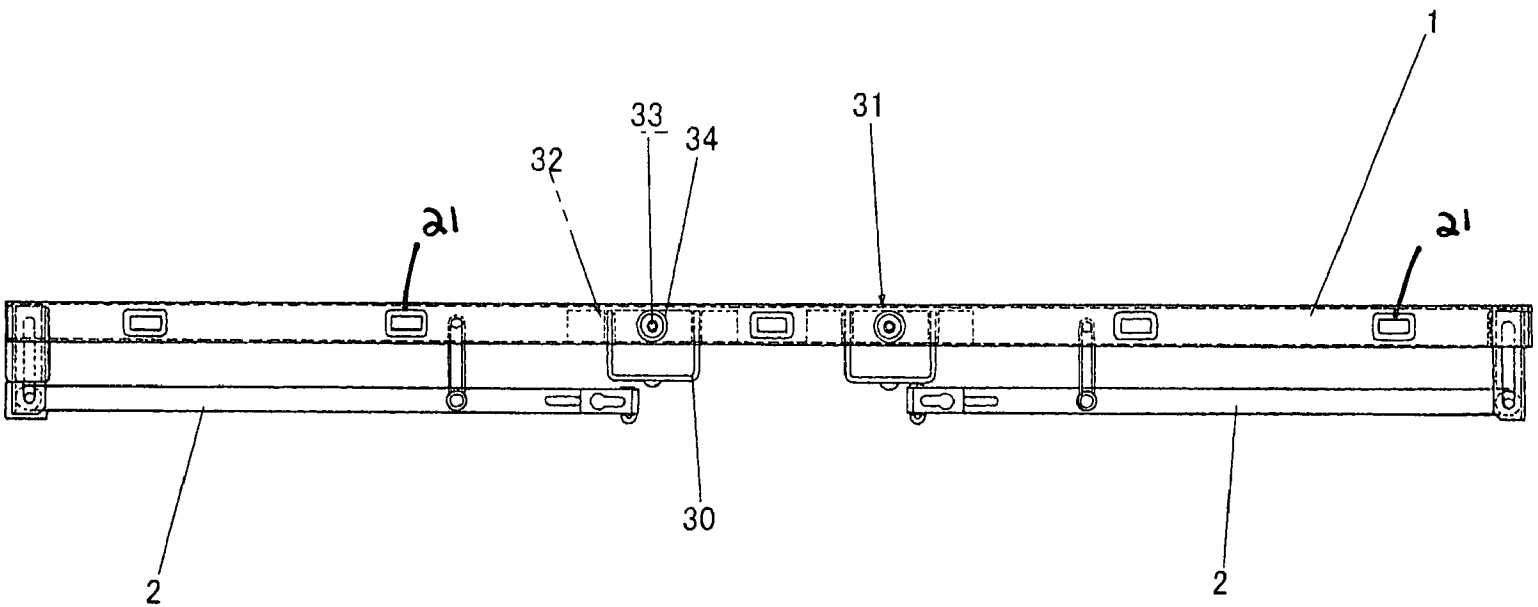
FIG. 6 Side elevation view of the loading rack with its legs folded.

With reference to the attached drawings, the present invention will hereinafter be described by way of an embodiment thereof. However, a structure of a hinge part, which is a feature of this invention, is focused on because the basic composition and advantages of the loading rack are otherwise the same as in the prior art.

FIGS. 1 to 6 illustrate a loading rack of the present invention. The loading rack has a table body 1, which has an oblong shape in plan view and is formed in a manner wherein square-shaped pipe components are assembled in a lattice pattern, and a pair of legs 2, are foldably attached, one each, to anterior/front and posterior/rear side parts of the table body 1. The leg 2 is capable of being placed in a vertical orientation (being able to be set up) or foldable in a state wherein the bottom surface of the table body 1 is raised by the fork of a forklift car. The state wherein the leg 2 is set up is referred as a "standing position" in the embodiment.

The table body 1 partitions off the loading space of box-shaped rear bodies of trucks (including bulk containers) into upward and downward, so that it enables to separately load pallets, on which baggage is loaded, on top of and below the table body 1. One leg 2, which is half as high as the box-shaped rear body of trucks, is fixed foldably to each of the posterior and anterior sides of the oblong table body 1.

A frame 3 at posterior and anterior ends of the table body 1 is made with side parts in the form of a square-shaped pipe whose entire length is the same as the horizontal dimension between lateral right and left sides of the table body 1. A plurality of mounting holes 4, each of which vertically goes through the frame are opened at spaced locations in a right-and-left direction of the frame 3. A square pipe shaped leg holder 5 is weld-fixed in each mounting hole 4. Each leg holder 5 projects downwardly lower than the bottom surface of the table body 1. A space inside the holder 5 is a supporting hole 6, which opens downwardly.

Each leg 2 has a leg base 7 which extends the entire right-and-left length of the loading rack, square pipe shaped poles 8 which are lined up in a right-and-left row, and a horizontal frame 9 which connects poles 8 next to each other at a vertically midway position of the poles 8. In this embodiment, the horizontal frame 9 is located at two vertical positions.

The leg holder 5 is located relative the leg 2 so that the pole 8 is inserted. Each raised (set up) pole 8 is capable to be inserted from below into the supporting hole 6 of the leg holder 5. In other words, each upper end of pole 8 is an insertion part 10, which is located at an upper part of each leg and capable to be inserted into the supporting hole 6. As this insertion part 10, which projects above the horizontal frame, is inserted into the supporting hole 6, the vertically standing leg 2 is held and fixed by peripheral walls bounding the hole 6.

Also, an onboarding frame 11 is weld-fixed between the poles 8 next to each other on a bottom surface of right and left sides of the table body 1. As insertion part 10 of the standing leg 2 is inserted into the supporting hole 6, the onboarding frame 11 is loaded on the horizontal frame 9 so that the table body is loaded on the leg 2.

A long hole 12, which extends vertically, is opened on the right and left walls of the leg holder 5. A latching pin 13, which engages the long hole 12, is fixed on an upper end part of the insertion part 10 of the leg. The insertion part 10 is inserted into and pulled out from the supporting hole 6 guided by the pin 13 and the long hole 12.

Moreover, an opening 14, which allows the leg 2 to be folded inside in the posterior-and-anterior direction as the leg 2 is moved along the supporting hole 6 until the latching pin 13 is located at a lower end of the long hole 12, is opened at a lower end part of a wall part inside in the posterior-and-anterior direction 8 of the leg holder 5. In other words, the shape of the cross section of the leg holder 5 has three walls and one opening which opens inside in the right-and-left direction.

The shape of the cross section of the insertion part 10 is oblong, which is almost the same as the shape of the cross section of the supporting hole 6. A column-shaped guiding part 15 is located on the upper end of the insertion part 10 so that friction resistance caused by opening and closing motion of the leg 2 is decreased. A diameter of the guiding part 15 is slightly smaller than the posterior-and-anterior width of the supporting hole 6. A shaft length of the guiding part 15 is slightly shorter than the right-and-left width of the supporting hole 6. The guiding part 15 is concentric with the latching pin 13.

To enhance stability of the leg 2 while it is standing, the upper horizontal frame 9 has a fixing pin 16 which projects upwardly at the middle of the right-and-left direction of each leg 2, and a fitting hole 17, in which the fixing pin 16 is inserted when the leg 2 is standing, is opened on the onboarding frame 11 of the middle of the table body 1.

Figure 7:
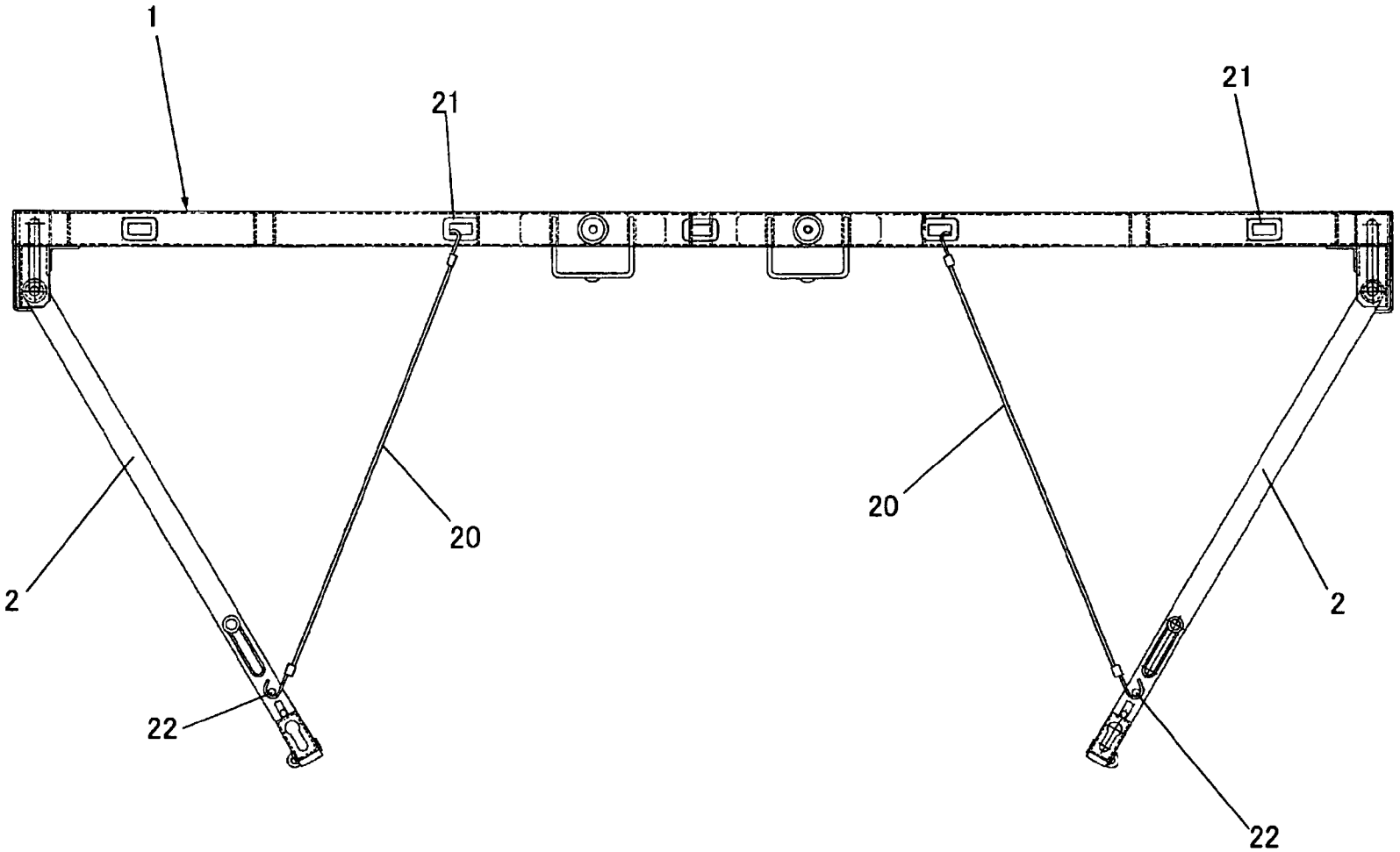
FIG. 7 View of the loading rack as in FIG. 6 during folding of the legs.

Also, as shown in FIG. 7, engaging parts 21 and 22, which latch an adjunctive rope 20, which suspends the leg 2 slightly folded inside, are located on the table body 1 and the leg 2 respectively. To hold the leg 2, the table body 1 is lifted up by using the forklift truck and the like, the leg 2, slightly folded, is suspended by the adjunctive rope 20, the table body 1 is lifted down onto the load carrying rack of the truck, and a lower end part of the leg 2 is pushed up by the load carrying rack, so that the leg 2 is easily folded. Additionally, the rope 20 might be pulled out from a reel attached to the leg or the table body.

A pair of claw bearing members 30, in which the fork of the forklift truck are inserted, is located on a lower surface of the table body 1. The pair of claw bearing members 30 is located on the lower surface of spaced lateral portions of the table body 1. The space between the claw bearing members 30, in each pair, is the same as the space between right and left forks of conventional forklift trucks. The location of the claw bearing members 30 is fixed in a manner wherein the center of gravity of the loading rack is supported when the fork is inserted into the claw bearing member 30 and the loading rack is lifted up by the fork so that the loading rack is balanced.

The claw bearing member 30 is formed from a metal plate which is bent into a shape which is a square without one side. The claw bearing member 30 is attached to a bracket fixed to a frame of a right-and-left end part of the table body 1 in a manner wherein the member is able to revolve, so that it is possible to choose the "state" from two states of the claw bearing member 30. One state is a "standing state" (FIG. 6) wherein the claw bearing member 30 is in one angular relationship at a right angle to the table body 1, and the other state is a "folded state" (FIG. 5) wherein the claw bearing member 30 is in a different angular orientation parallel to the table body 1.

An engaging member 31, which fixes the state with the claw bearing member in the folded state, wherein it is parallel to the table body 1, is provided. In this embodiment, this engaging member 31 has an engaging pin 33, which is attached slidably over a certain distance relative to a shaft, which goes through a bracket 32 and the frame of the table body 1. The engaging member 31 is flexibly pushed against a pin hole opened at the middle part of the claw bearing member 30 by a spring 34, and its end is engaged to the pin hole so that the folded state is maintained. A finger grip part of a head part of the engaging pin 33 is projected from a window, which is opened on the frame at a side surface of the table body 1. The engagement between the engaging pin 33 and the pin hole of the claw bearing member 30 is released by pinching and pulling this finger grip part with finger tips or industrial tools against the elastic force of the spring 34, and by that the claw bearing member 30 is capable to be pivoted so that the claw bearing member is in a standing state wherein it is at right angle to the flat surface of the table body 1.

An engaging member 31, which fixes the state as the claw bearing member 30 is in a folded state wherein it is parallel to the table body 1, is provided. In this embodiment, this engaging member 31 has an engaging pin 33, which is attached slidably in a certain distance to the shaft, which goes through a bracket 32 and the frame of the table body 1. The engaging member is flexibly pushed against a pin hole opened at the middle part of the claw bearing member 30 by a spring 34, and its end is engaged to the pin hole so that the folded state is kept. A finger grip part of a head part of the engaging pin is projected from a window, which is opened on the frame to the side-end-surface of the table body 1. The engagement between the engaging pin 33 and the pin hole of the claw bearing member 30 is released by pinching and pulling this finger grip part with finger chips or industrial tools against the elastic force of the spring 34, and by that the claw bearing member 30 is capable to be revolved so that the claw bearing member is in a standing state wherein it is at right angle to the flat surface of the table body 1.

Also, a holding assembly 35, which temporarily holds the standing state of the claw bearing member 30, wherein the claw bearing member is at right angle to the table body 1, is attached. In this embodiment, the holding assembly 35 is in the form of an elastic packing between the bracket and the claw bearing member 30, and temporarily holds the state by adding certain rotating torque to the claw bearing member 30.

It should be understood that the Preferred Embodiments does not describe all of the various changes that might be made to the specific examples given in this Preferred Embodiments. Consequently, this invention is not limited to the embodiment shown in figures herein and is able to be changed from what is specifically shown and described.

What is claimed is:

1. A loading rack comprising an oblong table body having a lateral extent and posterior and anterior ends and a pair of legs attached foldably to posterior and anterior side parts of said body, the loading rack further comprising:

a plurality of leg holders which are attached at laterally spaced locations to the posterior and anterior side parts of the table body;

a supporting hole which opens downwardly on each leg holder; and multiple insertion parts on an upper part of each of the legs which are capable of being inserted one each into the supporting holes, wherein each leg is held and fixed in a vertically standing position by peripheral walls surrounding the supporting holes as insertion parts are inserted into the supporting holes and the table body is loaded on the leg, the loading rack further comprising a claw bearing member attached to a lateral portion of the table body in which a fork of a forklift truck can be inserted, wherein the claw bearing member is attached at a location so that the rack is able to be balanced when the fork is inserted in the claw bearing member, wherein the claw bearing member is changeable between a standing state and a closed state, the standing state wherein the claw bearing member is in one angular relationship to the table body, and the closed state wherein the claw bearing member is in a different angular relationship to the table body.

2. A loading rack as described in claim 1, further comprising an engaging member which fixes the state of the claw bearing member in the closed state.

3. A loading rack as described in claim 1, further comprising a holding assembly which temporarily holds the standing state of the claw bearing member.

* * * * *